US008187387B2

(12) United States Patent
Kim et al.

(10) Patent No.: US 8,187,387 B2
(45) Date of Patent: May 29, 2012

(54) DRYER AND METHOD OF CONTROLLING CLEANING OPERATION THEREOF

(75) Inventors: Tai Eun Kim, Suwon-si (KR); Jeong Han Kim, Suwon-si (KR); Byoung Yull Yang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 980 days.

(21) Appl. No.: 12/216,801

(22) Filed: Jul. 10, 2008

(65) Prior Publication Data

US 2009/0249639 A1 Oct. 8, 2009

(30) Foreign Application Priority Data

Apr. 2, 2008 (KR) ..... 10-2008-0030670

(51) Int. Cl.
*B08B 7/04* (2006.01)

(52) U.S. Cl. ..... 134/18; 134/26; 134/30; 134/32; 134/33; 134/34; 134/42; 34/85; 34/380; 34/389; 34/391; 34/393; 34/395; 34/428; 34/443; 34/474; 34/475; 34/476; 34/480; 34/486; 34/491; 34/499; 34/542; 34/597

(58) Field of Classification Search ..... 34/85, 380, 34/389, 391, 393, 395, 428, 443, 474, 475, 34/476, 480, 486, 491, 499, 542, 597; 134/18, 134/26, 30, 32, 33, 34, 42
See application file for complete search history.

(56) References Cited

U.S. PATENT DOCUMENTS

| | | | | |
|---|---|---|---|---|
| 2,722,057 | A * | 11/1955 | Pugh | 34/74 |
| 3,029,525 | A * | 4/1962 | Pinder | 34/75 |
| 5,649,372 | A * | 7/1997 | Souza | 34/491 |
| 6,062,238 | A * | 5/2000 | Korte et al. | 134/22.1 |
| 2005/0198852 | A1 * | 9/2005 | Ono et al. | 34/77 |
| 2007/0006484 | A1 * | 1/2007 | Moschuetz et al. | 34/597 |
| 2008/0148596 | A1 * | 6/2008 | Son et al. | 34/486 |

FOREIGN PATENT DOCUMENTS

JP 2006-141579 6/2006

* cited by examiner

*Primary Examiner* — Bibi Carrillo
(74) *Attorney, Agent, or Firm* — Staas & Halsey LLP

(57) ABSTRACT

Disclosed herein are a dryer and a method of controlling a cleaning operation thereof that are capable of supplying moisture into a drying chamber of the dryer to wet contaminants in the drying chamber and blowing air to the wetted contaminants to remove the contaminants. The method includes supplying moisture into a drying chamber to wet contaminants in the drying chamber and removing the contaminants wetted by the moisture.

16 Claims, 12 Drawing Sheets

DRYER AND METHOD OF CONTROLLING CLEANING OPERATION THEREOF

CROSS-REFERENCE TO RELATED APPLICATIONS

This application claims the priority benefit of Korean Patent Application No. 2008-0030670, filed on Apr. 2, 2008 in the Korean Intellectual Property Office, the disclosure of which is incorporated herein by reference.

BACKGROUND

1. Field

The present invention relates to a dryer, and, more particularly, to a dryer to dry clothes and a method of controlling the same.

2. Description of the Related Art

A dryer is an apparatus that applies air, particularly hot air, to an object to be dried to remove moisture from the object. A clothes dryer may be classified as a washer having a drying function or an exclusive dryer to dry only clothes. The washer having the drying function applies hot air to washed laundry to remove moisture from the laundry, thereby drying the laundry. The exclusive dryer can remove smells from clothes in addition to drying the clothes. Consequently, a user often uses the dryer not to dry but to deodorize clothes.

When deodorizing clothes, the clothes may not be wetted. For this reason, when a drying operation is carried out while dry clothes are placed in a dryer, lint or other foreign matter, separated from the clothes, accumulates on the surface of a drying chamber, with the result that the drying chamber is contaminated.

When clothes are dried by a dryer of which a drying chamber is contaminated, the clothes are also contaminated due to contaminated drying chamber, which brings about users' dissatisfaction.

SUMMARY

In accordance with an aspect of the present invention, there is provided a dryer and a method of controlling a cleaning operation thereof that are capable of supplying moisture into a drying chamber of the dryer to wet contaminants in the drying chamber and blowing air to the wetted contaminants to remove the contaminants.

In accordance with one aspect of the present invention, there is provided a method of controlling a cleaning operation of a dryer, including supplying moisture into a drying chamber to wet contaminants in the drying chamber and removing the contaminants wetted by the moisture.

The drying chamber may be a rotary drum, and the method may further include rotating the drum while supplying the moisture.

The method may further include measuring the temperature of the drying chamber before the supply of the moisture and cooling the drying chamber when the measured temperature of the drying chamber is higher than a predetermined temperature.

The cooling operation of the drying chamber may naturally cool the drying chamber to the predetermined temperature or less than the predetermined temperature.

The cooling operation of the drying chamber may forcibly cool the drying chamber to the predetermined temperature or less than the predetermined temperature.

The cooling operation of the drying chamber may exhaust air in the drying chamber outside and may supply external air into the drying chamber to forcibly cool the drying chamber.

The cooling operation of the drying chamber may circulate cool air in the drying chamber to forcibly cool the drying chamber.

The method may further include performing a cooling operation to lower the temperature of the drying chamber for a first predetermined time before the supply of the moisture.

The cooling operation of the drying chamber may naturally cool the drying chamber to the predetermined temperature or less than the predetermined temperature.

The cooling operation of the drying chamber may forcibly cool the drying chamber to the predetermined temperature or less than the predetermined temperature.

The cooling operation of the drying chamber may exhaust air in the drying chamber outside and may supply external air into the drying chamber to forcibly cool the drying chamber.

The cooling operation of the drying chamber may circulate and cool air in the drying chamber to forcibly cool the drying chamber.

The method may further include waiting for a second predetermined time, such that the supplied moisture is coupled to the contaminants in the drying chamber after the supply of the moisture is completed.

The operation of removing the contaminants may include blowing air into the drying chamber.

The air may be heated air.

The drying chamber may be a rotary drum, and the method may further include rotating the drum while blowing the air.

The operation of removing the contaminants may include circulating the air in the drying chamber through a filter for a third predetermined time or exhausting the air in the drying chamber outside through the filter and supplying external air into the drying chamber to remove the contaminants.

The operation of removing the contaminants may include detecting the contamination degree of the air discharged from the drying chamber, the removing of the contaminants being performed until the contamination degree of the air discharged from the drying chamber is lower than or equal to a predetermined contamination degree.

The operation of removing the contaminants may include detecting the humidity of the air discharged from the drying chamber, the removing of the contaminants being performed until the humidity of the air discharged from the drying chamber is lower than or equal to a predetermined humidity.

The cleaning operation may be performed based on a user's input.

The cleaning operation may be automatically performed when cumulative drying operation execution time of the dryer reaches a fourth predetermined time.

The method may further include displaying the completion of the removal of the contaminants after the removal of the contaminants is completed.

The moisture may be mist or steam.

In accordance with another aspect of the present invention, there is provided a method of controlling a cleaning operation of a dryer, including measuring the temperature of a drying chamber, performing a cooling operation to lower the temperature of the drying chamber to a predetermined temperature when the measured temperature is higher than the predetermined temperature, supplying moisture into the drying chamber to wet contaminants in the drying chamber, forming a contaminant film by soaking the contaminants wetted by the moisture, and removing the contaminant film.

The cooling operation of the drying chamber is to naturally cool the drying chamber to the predetermined temperature or less than the predetermined temperature.

The cooling operation of the drying chamber is to forcibly cool the drying chamber to the predetermined temperature or less than the predetermined temperature.

The removing the contaminant film includes circulating air in the drying chamber through a filter for a third predetermined time or exhausting the air in the drying chamber outside through the filter and supplying external air into the drying chamber to remove the contaminants.

The removing the contaminant film includes detecting the contamination degree and/or humidity of air discharged from the drying chamber, the removing the contaminant film being performed until the contamination degree and/or humidity of the air discharged from the drying chamber is lower than or equal to predetermined contamination degree and/or humidity.

In accordance with another aspect of the present invention, there is provided a method of controlling a cleaning operation of a dryer, including performing a cooling operation to lower the temperature of a drying chamber for a first predetermined time, supplying moisture into the drying chamber to wet contaminants in the drying chamber, forming a contaminant film by soaking the contaminants wetted by the moisture, and removing the contaminant film.

The cooling operation of the drying chamber is to naturally cool the drying chamber to a predetermined temperature or less than the predetermined temperature.

The cooling operation of the drying chamber is to forcibly cool the drying chamber to a predetermined temperature or less than the predetermined temperature.

The removing the contaminant film includes circulating air in the drying chamber through a filter for a third predetermined time or exhausting the air in the drying chamber outside through the filter and supplying external air into the drying chamber to remove the contaminants.

The removing the contaminant film includes detecting the contamination degree and/or humidity of air discharged from the drying chamber, the removing the contaminant film being performed until the contamination degree and/or humidity of the air discharged from the drying chamber is lower than or equal to predetermined contamination degree and/or humidity.

In accordance with a further aspect of the present invention, there is provided a dryer including a drying chamber, a moisture supply unit to supply moisture into the drying chamber through a moisture supply pipe and spray nozzle, a drying unit to dry clothes in the drying chamber, and a controller to control the moisture supply unit to supply moisture into the drying chamber, such that contaminants in the drying chamber are wetted by the moisture, and control the drying unit to remove the contaminants wetted by the moisture, thereby performing a cleaning operation.

The drying chamber may be a rotary drum, and the controller may control the drum to be rotated during the supply of the moisture.

The dryer may further include a temperature sensor to sense the temperature of the drying chamber, and the controller may control the drying unit to blow air into the drying chamber, such that the drying chamber is cooled, when the temperature of the drying chamber is higher than a predetermined temperature, before the moisture is supplied into the drying chamber.

The dryer may further include an input button to allow a user to select the cleaning operation.

The dryer may further include a contamination sensor to sense the contamination degree of air discharged from the drying chamber, and the controller may control the cleaning operation to be performed until the contamination degree of the air discharged from the drying chamber is lower than or equal to a predetermined contamination degree.

The dryer may further include a humidity sensor to sense the humidity of air discharged from the drying chamber, and the controller may control the cleaning operation to be performed until the humidity of the air discharged from the drying chamber is lower than or equal to a predetermined humidity.

The dryer may further include a display to display the completion of the cleaning operation after the cleaning operation is completed.

The moisture may be mist or steam.

BRIEF DESCRIPTION OF THE DRAWINGS

These and/or other aspects, features, and advantages of the invention will become apparent and more readily appreciated from the following description of exemplary embodiments, taken in conjunction with the accompanying drawings, of which.

DETAILED DESCRIPTION OF EMBODIMENTS

Figure 1:
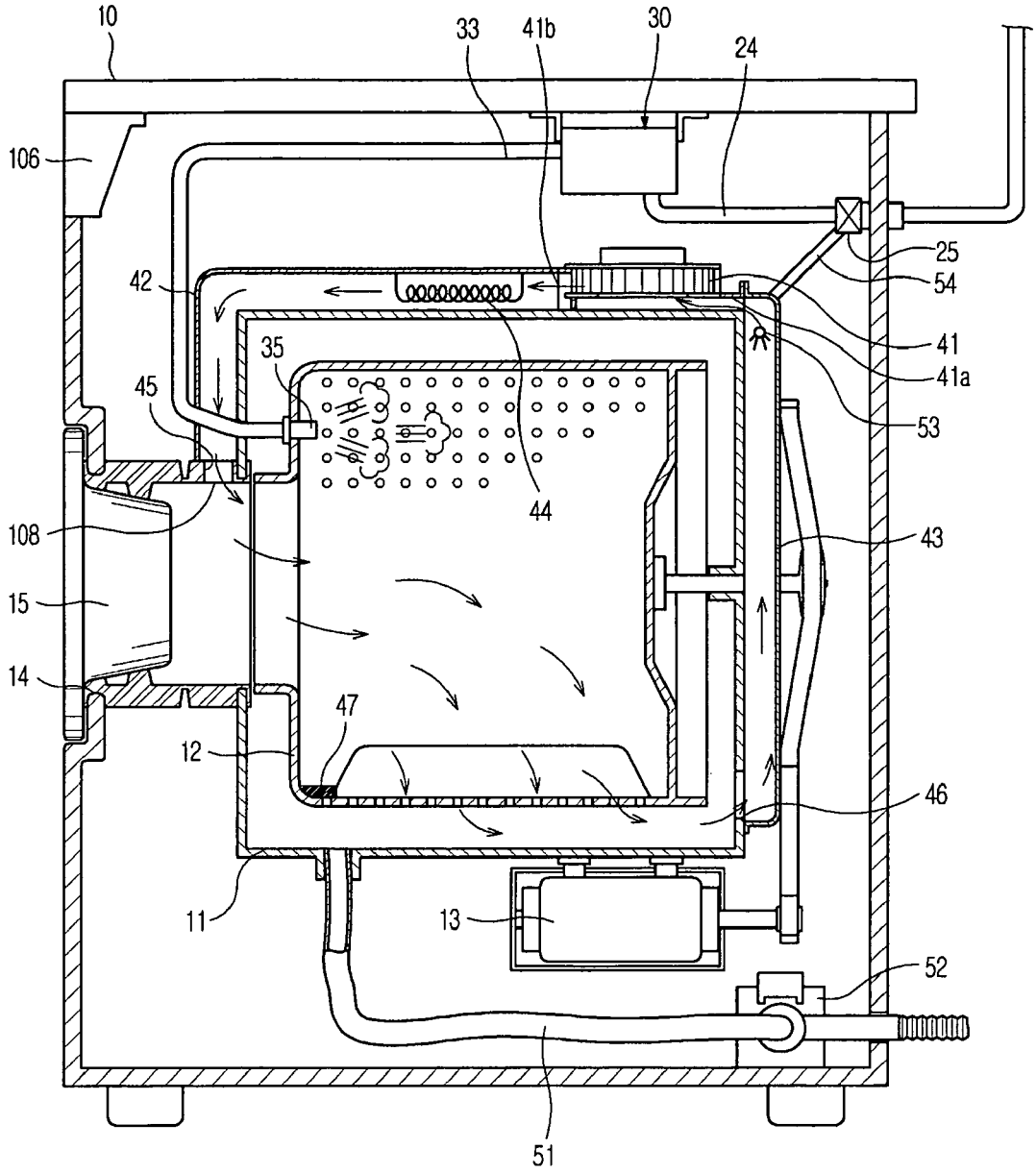
FIG. 1 is a sectional view illustrating the structure of a dryer according to a first exemplary embodiment of the present invention.

Reference will now be made in detail to exemplary embodiments of the present invention, examples of which are illustrated in the accompanying drawings, wherein like reference numerals refer to like elements throughout. Exemplary embodiments are described below to explain the present invention by referring to the figures.

FIG. 1 is a sectional view illustrating the structure of a dryer according to a first exemplary embodiment of the present invention. This dryer is a drum type dryer having a rotary drum 12. Also, this dryer is a circulation type dryer in which air blown by a drying fan 41 circulates in the dryer.

As shown in FIG. 1, the dryer according to the first exemplary embodiment of the present invention is constructed in a structure in which a drum 12 having a plurality of holes is rotatably mounted in a dryer body 10, and clothes (i.e., objects to be dried) are received in the drum 12. In this exemplary embodiment, an inner space of the drum 12 and an installation space 11 of the drum 12 will be referred to as a drying chamber. Below the drum 12 is mounted a motor 13 to rotate the drum 12 in the forward direction or the reverse direction. In front of the drum 12 is formed an opening 14 through which a user withdraws clothes in front of the dryer body 10. The opening 14 is selectively opened and closed by a door 15 mounted at the dryer body 10.

Above the drum 12 are mounted a moisture supply unit 30 to supply moisture (mist/steam) into the drum 12 and a water supply pipe 24 and a water supply valve 25 as a water supply unit to supply water to the moisture supply unit 30. The moisture supply unit 30 supplies mist or steam. An example of a moisture supply unit 30 to supply mist may be configured to vibrate water using an ultrasonic vibrator and supply generated mist. An example of a moisture supply unit 30 to supply steam may be configured to heat water to high temperature and supply generated steam. The moisture supply unit 30 connects to a moisture supply pipe 33 extending from the moisture supply unit 30 to the drum 12 to supply moisture (mist/steam) into the drum 12 and a spray nozzle 35 mounted at the outlet of the moisture supply pipe 33.

Also, the dryer of FIG. 1 includes a drying fan 41, drying duct 42, a condensing duct 43, a drying heater 44, a humidity sensor 47, and a condensing unit 53, 25, and 54, as a drying unit to dry clothes. The drying fan 41 is mounted above the drum 12. The drying duct 42 is connected between a discharge port 41*b* of the drying fan 41 and an air inlet port 45 formed at the upper side of the opening 14. In one end of the drying duct 42 is mounted a filter 108 to filter out contaminants from air to be introduced into the drying chamber through the drying duct 42. The condensing duct 43 is connected between an air outlet port 46 and a suction port 41*a* of the drying fan 41 at the lower rear of the drum 12. The drying heater 44 is mounted in the drying duct 42 such that heated air is supplied into the drum 12. The humidity sensor 47 is mounted in the drum 12 to detect the interior humidity of the drum 12 and sense the dry state of clothes based on the detected interior humidity of the drum 12. The condensing unit 53, 25, and 54 is mounted at the condensing duct 43 such that moisture is condensed and removed from wet air generated when drying clothes during the passage of the wet steam through the condensing duct 43.

The condensing unit 53, 25, and 54 includes a cooling water spray nozzle 53 mounted in the upper part of the condensing duct 43 to spray cooling water into the condensing duct 43, a water supply valve 25, and a cooling water supply pipe 54, connected to water supply valve 25, to supply cooling water to the cooling water spray nozzle 53. According to the structure of the condensing unit 53, 25, and 54, cooling water, sprayed from the cooling water spray nozzle 53, falls to the lower part of the condensing duct 43 along the inner surface of the condensing duct 43, with the result that the contact between the cooling water and wet air rising from the lower part of the condensing duct 43 increases, whereby condensing efficiency increases.

Also, the dryer includes a drainage pipe 51 and a drainage pump 52, as a drainage unit to drain moisture generated during the clothes drying process. The drainage pipe 51 guides water generated from the drum 12 outside, and the drainage pump 52 is mounted on the drainage pipe 51 to assist the drainage process.

At the upper front of the dryer body 10 is mounted a control panel 106 to allow a user to input a drying operation condition.

Figure 2:
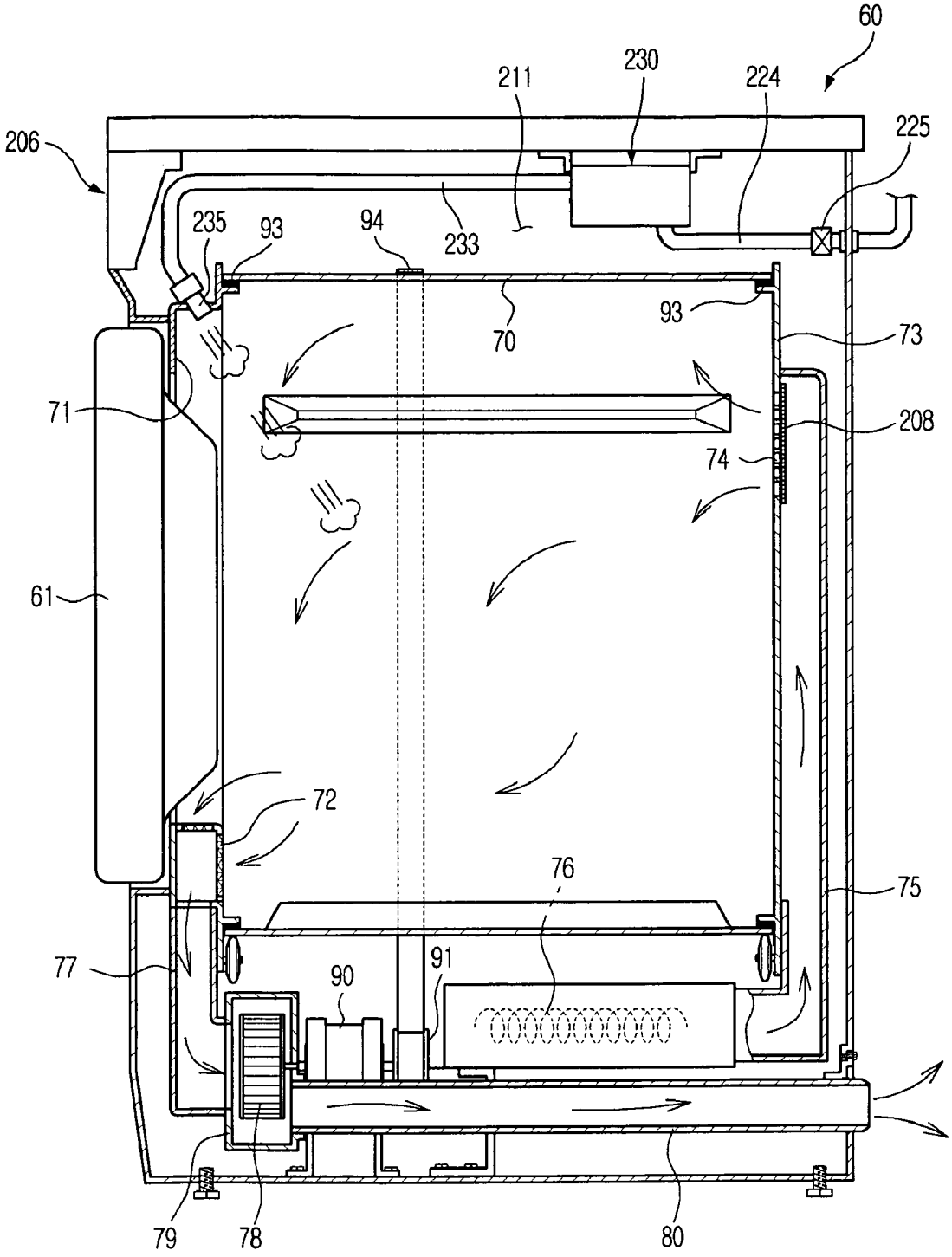
FIG. 2 is a sectional view illustrating the structure of a dryer according to a second exemplary embodiment of the present invention.

FIG. 2 is a sectional view illustrating the structure of a dryer according to a second exemplary embodiment of the present invention. This dryer is an open type dryer in which air blown by a drying fan 78 passes through the dryer and is then discharged outside.

As shown in FIG. 2, the dryer according to the second exemplary embodiment of the present invention is constructed in a structure in which above a drum 70 are mounted a moisture supply unit 230 to supply moisture (mist/steam) into the drum 70 and a water supply pipe 224 and a water supply valve 225 as a water supply unit to supply water to the moisture supply unit 230. The moisture supply unit 230 supplies mist or steam. An example of a moisture supply unit 230 to supply mist may be configured to vibrate water using an ultrasonic vibrator and supply generated mist. An example of a moisture supply unit 230 to supply steam may be configured to heat water to high temperature and supply generated steam. The moisture supply unit 230 connects to a moisture supply pipe 233 extending from the moisture supply unit 230 to the drum 70 to supply moisture (mist/steam) into the drum 70 and a spray nozzle 235 mounted at the outlet of the moisture supply pipe 233.

The drum 70, which is constructed in the form of a cylinder open at the front and rear thereof, is mounted in a dryer body 60. The drum 70 is supported by a front bracket 71 and a rear bracket 73 to slidably support the front and rear end inner circumferences of the drum 70. Between the drum 70 and the front bracket 71 and between the drum 70 and the rear bracket 73 are mounted slide pads 93 to assist smooth rotation of the drum 70. In this exemplary embodiment, an inner space of the drum 70 and an installation space 211 of the drum 70 will be referred to as a drying chamber.

At the upper part of the rear bracket 73 is formed an intake port 74 to suction hot air. At the rear of the rear bracket 73 is mounted an intake duct 75 to guide hot air to the intake port 74. In the intake duct 75, at the position where the intake port 74 is formed, is mounted a filter 208 to filter out contaminants from air to be introduced into the drying chamber through the intake duct 75. The intake duct 75 extends rearward below the drum 70 and is bent upward to communicate with the intake port 74. At the inlet of the intake duct 75 is mounted a drying heater 76 to heat air suctioned from the interior of the dryer body 60.

The front bracket 71 is open at the center thereof to allow clothes (i.e., objects to be dried) to be introduced from a door 61 side. At the lower part of the front bracket 71 is formed an exhaust port 72 to discharge air containing moisture evaporated from the objects outside. Below the drum 70 are mounted an exhaust duct 77, a drying fan 78, and an exhaust pipe 80 to discharge air discharged from the exhaust port 72 out of the dryer. The exhaust duct 77 guides air discharged from the exhaust port 72 to the lower part of the dryer body 60. The exhaust duct 77 is connected to the drying fan 78 to generate a flow force to guide air in the dryer. One end of the exhaust pipe 80 is connected to a fan casing 79 of the drying fan 78, and the other end of the exhaust pipe 80 extends outside the dryer body 60. Air discharged by the drying fan 78 is exhausted out of the dryer through the exhaust pipe 80.

At the lower part of the dryer body 60 is mounted a motor 90 to drive the drying fan 78 and the drum 70. The motor 90 has a drive shaft extending frontward and rearward. One end of the drive shaft is connected to the drying fan 78, and the other end of the drive shaft is connected to a pulley 91 to drive the drum 70. The pulley 91 and the drum 70 are connected to each other via a belt 94. The rotation of the motor 90 is transmitted to the drum 70 via the pulley 91 and the belt 94, with the result that the drum 70 is rotated. Here, one end of the drive shaft of the motor 90 is connected to the drying fan 78 via a clutch (not shown), and the other end of the drive shaft of the motor 90 is connected to the pulley 91 via another clutch (not shown). Consequently, it is possible to rotate both the drying fan 78 and the drum 70 or selectively rotate either the drying fan 78 or the drum 70 through the connection/release of the respective clutches.

At the upper front of the dryer body 70 is mounted a control panel 206 to allow a user to input a drying operation condition.

Figure 3:
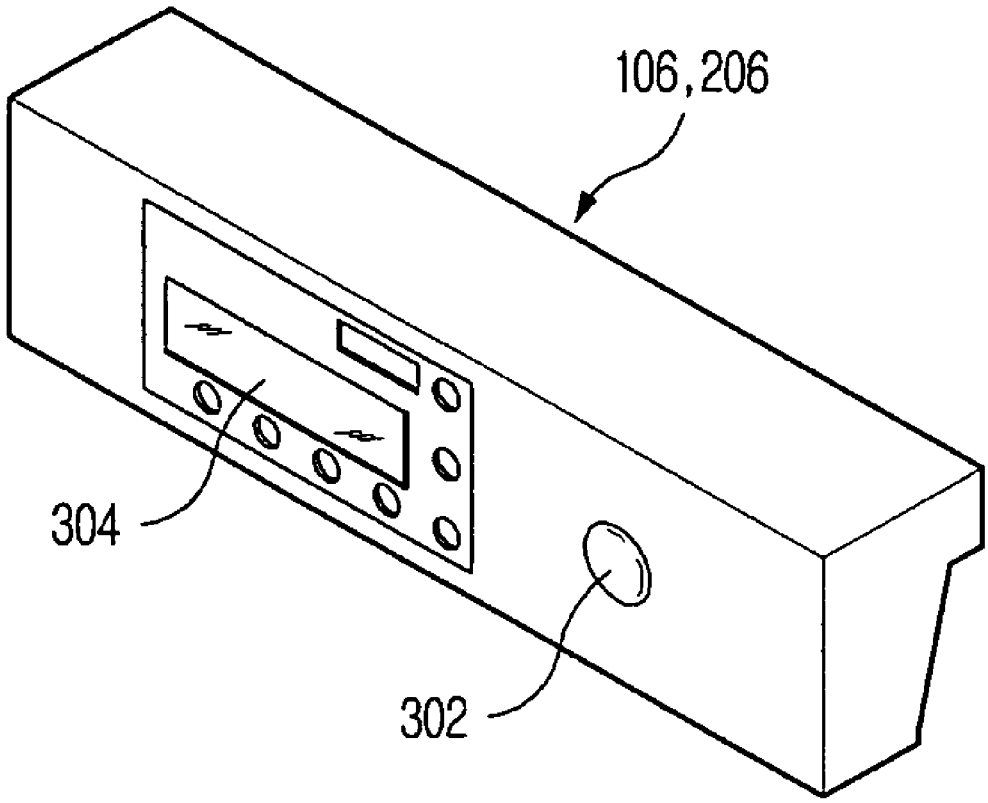
FIG. 3 is a view illustrating a control panel applied to the dryers of FIGS. 1 and 2.

FIG. 3 is a view illustrating the control panel 106 or 206 of the dryer shown in FIG. 1 or 2. As shown in FIG. 3, the control panel 106 or 206 of the dryer according to the present invention includes a plurality of buttons to allow a user to input an operation condition and a display 304 to display the current operation state of the dryer. Among the buttons is a cleaning operation button 302 to allow a user to select a cleaning operation and input a cleaning operation command. Consequently, when a user determines that the cleaning operation of the dryer is needed, the user pushes the cleaning operation button 302 to perform the cleaning operation of the dryer according to the present invention.

Figure 4:
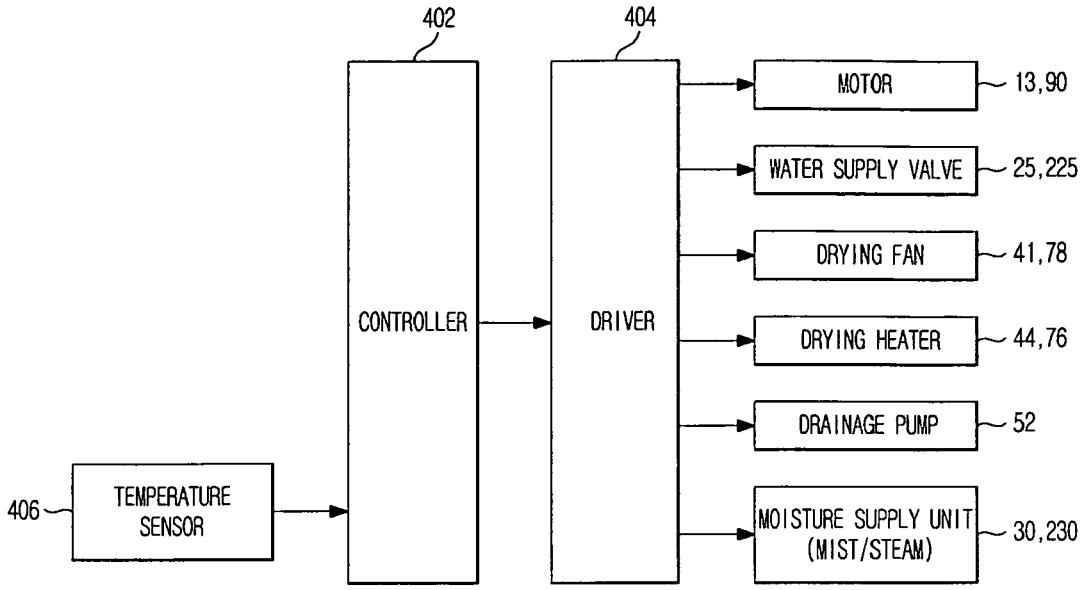
FIG. 4 is a block diagram illustrating a control system of a dryer according to a third exemplary embodiment of the present invention.

FIG. 4 is a block diagram illustrating a control system of a dryer according to a third exemplary embodiment of the present invention. As shown in FIG. 4, a driver 404 to drive a plurality of electric devices provided in the dryer is electrically connected to the output side of a controller 402 to control the overall operation of the dryer. The controller 402 controls the driver 404 to drive the motor 13 or 90, the water supply valve 25 or 225, the drying fan 41 or 78, the drying heater 44 or 76, the drainage pump 52, and the moisture supply unit 30 or 230 previously described with reference to FIG. 1 or 2.

A temperature sensor 406 is connected to the input side of the controller 402. The temperature sensor 406 senses the temperature of a drying chamber and transmits the sensed temperature value to the controller 402. This temperature sensor is not shown in FIGS. 1 and 2; however, the installation position of the temperature sensor is not particularly restricted so long as the temperature sensor can sense the temperature of the drying chamber.

The controller 402 confirms the temperature of the drying chamber through the temperature sensor 406 and determines whether the temperature of the drying chamber is higher than a first predetermined temperature (for example, room temperature of approximately 25° C.). When the temperature of the drying chamber is higher than the first predetermined temperature, i.e., 25° C., the controller 402 controls the dryer to perform a cooling operation to lower the temperature of the drying chamber and supply moisture to the drying chamber. The reason why the cooling operation is performed when the temperature of the drying chamber is higher than the room temperature is that it is necessary to lower the temperature of the drying chamber such that moisture supplied into the drying chamber is sufficiently and uniformly applied to the surface of the drying chamber. If the temperature of the drying chamber is too high, when moisture, such as mist/steam, is supplied into the drying chamber, evaporation is easily carried out due to the high temperature, with the result that moisture may not be sufficiently and uniformly applied to the surface of the drying chamber.

Figure 5:
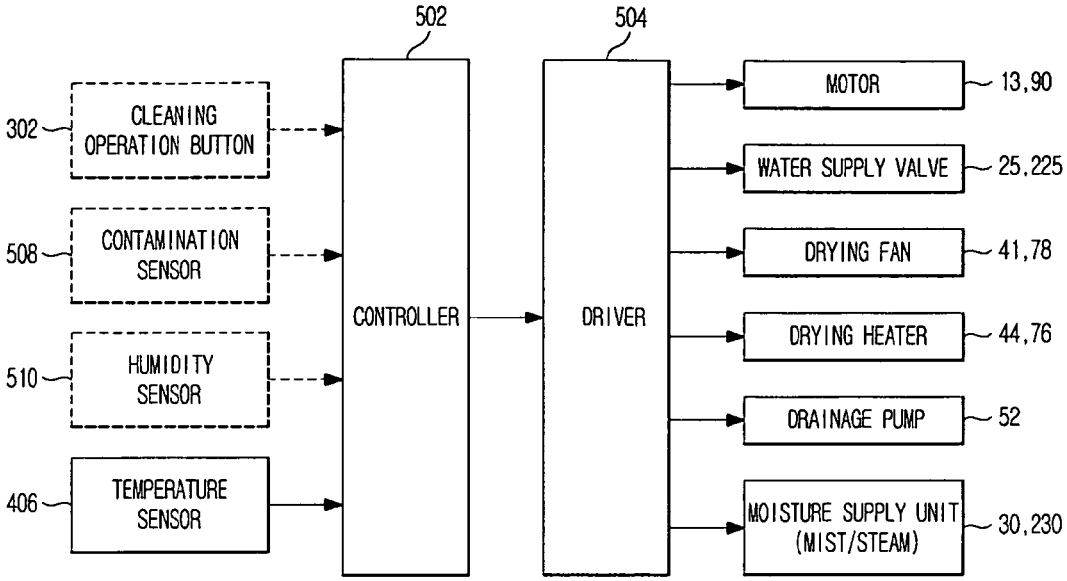
FIG. 5 is a block diagram illustrating a control system of a dryer according to a fourth exemplary embodiment of the present invention.

FIG. 5 is a block diagram illustrating a control system of a dryer according to a fourth exemplary embodiment of the present invention. As shown in FIG. 5, a cleaning operation button 302, a contamination sensor 508, and a humidity sensor 510 are selectively connected to the input side of the controller 402, which controls the overall operation of the dryer in addition to the temperature sensor 406. That is, the cleaning operation button 302, the contamination sensor 508, and the humidity sensor 510 are entirely or partially mounted according to a control method to be implemented. The cleaning operation button 302 and the temperature sensor 406 have the same function as described with reference to FIGS. 3 and 4. The contamination sensor 508 senses the contamination degree of the drying chamber. The contamination sensor 508 senses the turbidity of air circulating in the drying chamber or the turbidity of air discharged from the drying chamber to the outside and transmits the sensed value to the controller 502. The humidity sensor 510 senses the humidity of the drying chamber. The humidity sensor 510 senses the humidity of air circulating in the drying chamber or the humidity of air discharged from the drying chamber to the outside and transmits the sensed value to the controller 502.

The controller 502 decides the point of time to end the cleaning operation based on the detection result of the contamination sensor 508 and/or the detection result of the humidity sensor 510. That is, when the controller 502 determines that the contamination degree and the humidity of the drying chamber have been sufficiently lowered, i.e., when the control 502 determines that the contaminations of the drying chamber have been sufficiently removed, and the moisture supplied at the early stage of the cleaning operation has been sufficiently removed and thus the drying chamber has been sufficiently dried, the controller 502 controls the driver 504 to end the operations of the devices related to the cleaning operation, such as the motor 13 or 90, the drying fan 41 or 78, the drying heater 44 or 76, and the moisture supply unit 30 or 230, and ends the cleaning operation. Alternatively, the controller 502 may decide the point of time to end the cleaning operation based on either the contamination degree or the humidity of the drying chamber as necessary.

Figure 6:
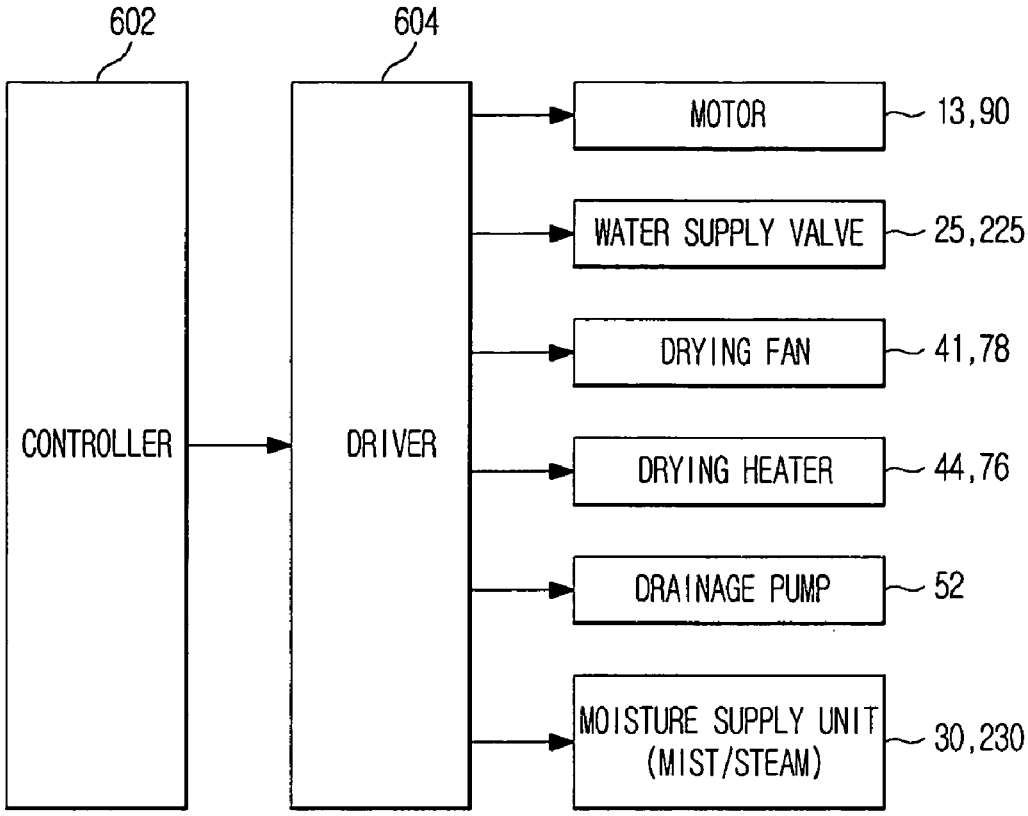
FIG. 6 is a block diagram illustrating a control system of a dryer according to a fifth exemplary embodiment of the present invention.

FIG. 6 is a block diagram illustrating a control system of a dryer according to a fifth exemplary embodiment of the present invention. The dryer according to the fifth exemplary embodiment of the present invention does not have a temperature sensor. In the dryer having no temperature sensor, as shown in FIG. 6, a controller 602 controls a driver 604 to drive the drying fan 41 or 78 at the early stage of a cleaning operation to perform a cooling operation of the drying chamber for a predetermined period of time.

Figure 7:
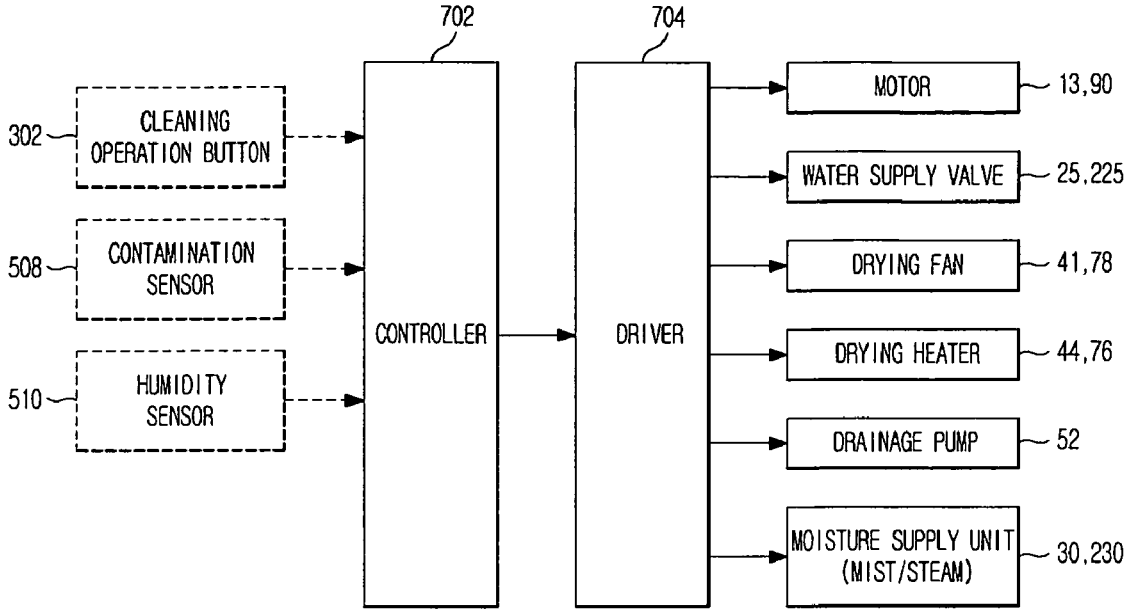
FIG. 7 is a block diagram illustrating a control system of a dryer according to a sixth exemplary embodiment of the present invention.

FIG. 7 is a block diagram illustrating a control system of a dryer according to a sixth exemplary embodiment of the present invention. The dryer according to the sixth exemplary embodiment of the present invention does not have a temperature sensor, and the cleaning operation button 302, the contamination sensor 508, and the humidity sensor 510 are selectively connected to the input side of a controller 702. That is, the cleaning operation button 302, the contamination sensor 508, and the humidity sensor 510 are entirely or partially mounted according to a control method to be implemented, as previously described with reference to FIG. 5.

The controller 702 decides the point of time to end the cleaning operation based on the detection result of the contamination sensor 508 and/or the detection result of the humidity sensor 510. Also, the controller 702 controls a driver 704 to end the operations of the devices related to the cleaning operation, such as the motor 13 or 90, the drying fan 41 or 78, the drying heater 44 or 76, and the moisture supply unit 30 or 230, and ends the cleaning operation. Alternatively, the controller 502 may decide the point of time to end the cleaning operation based on either the contamination degree or the humidity of the drying chamber as necessary.

For reference, even in the dryer having the temperature sensor 406 and deciding whether to perform the cooling operation based on the sensed temperature, as shown in FIG. 4, the controller 702 may omit the temperature sensing process and control the driver 704 to drive the motor 13 or 90 or the drying fan 41 or 78 to perform the cooling operation for the predetermined period of time, as shown in FIG. 7, when the temperature sensor 406 does not normally operate due to the breakdown thereof.

Figure 8:
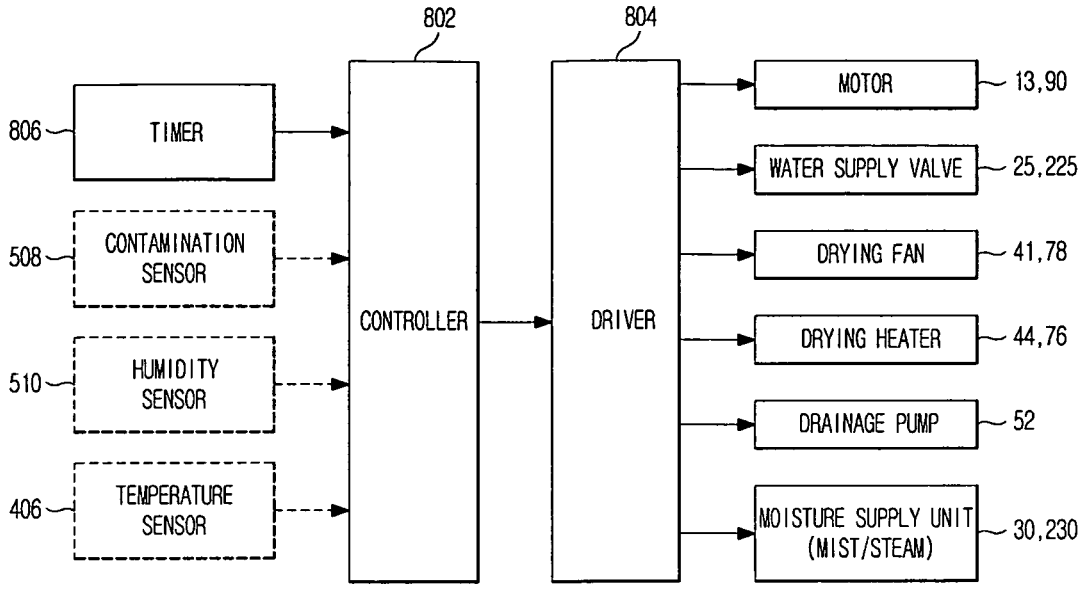
FIG. 8 is a block diagram illustrating a control system of a dryer according to a seventh exemplary embodiment of the present invention.

FIG. 8 is a block diagram illustrating a control system of a dryer according to a seventh exemplary embodiment of the present invention. As shown in FIG. 8, the contamination sensor 508, the humidity sensor 510, and the temperature sensor 406 are selectively connected to the input side of a controller 802. In addition, a timer 806 is further connected to the input side of the controller 802. The timer 806 provides a basis on which the controller 802 decides whether to perform the cleaning operation of the dryer. That is, the timer 806 counts drying operation time performed in the dryer and transmits the counted value to the controller 802. The controller 802 adds up the respective drying operation times transmitted from the timer 806 to calculate the total drying operation times. When the total drying operation times exceed a predetermined time (a fourth predetermined time), the controller 802 determines that the drying chamber is contaminated more than a predetermined level due to long-time drying operation and controls the driver 804 to drive the motor 13 or 90, the water supply valve 25 or 225, the drying fan 41 or 78, the drying heater 44 or 76, the drainage pump 52, and the moisture supply unit 30 or 230 to perform the cleaning operation for contamination removal.

Figure 9:
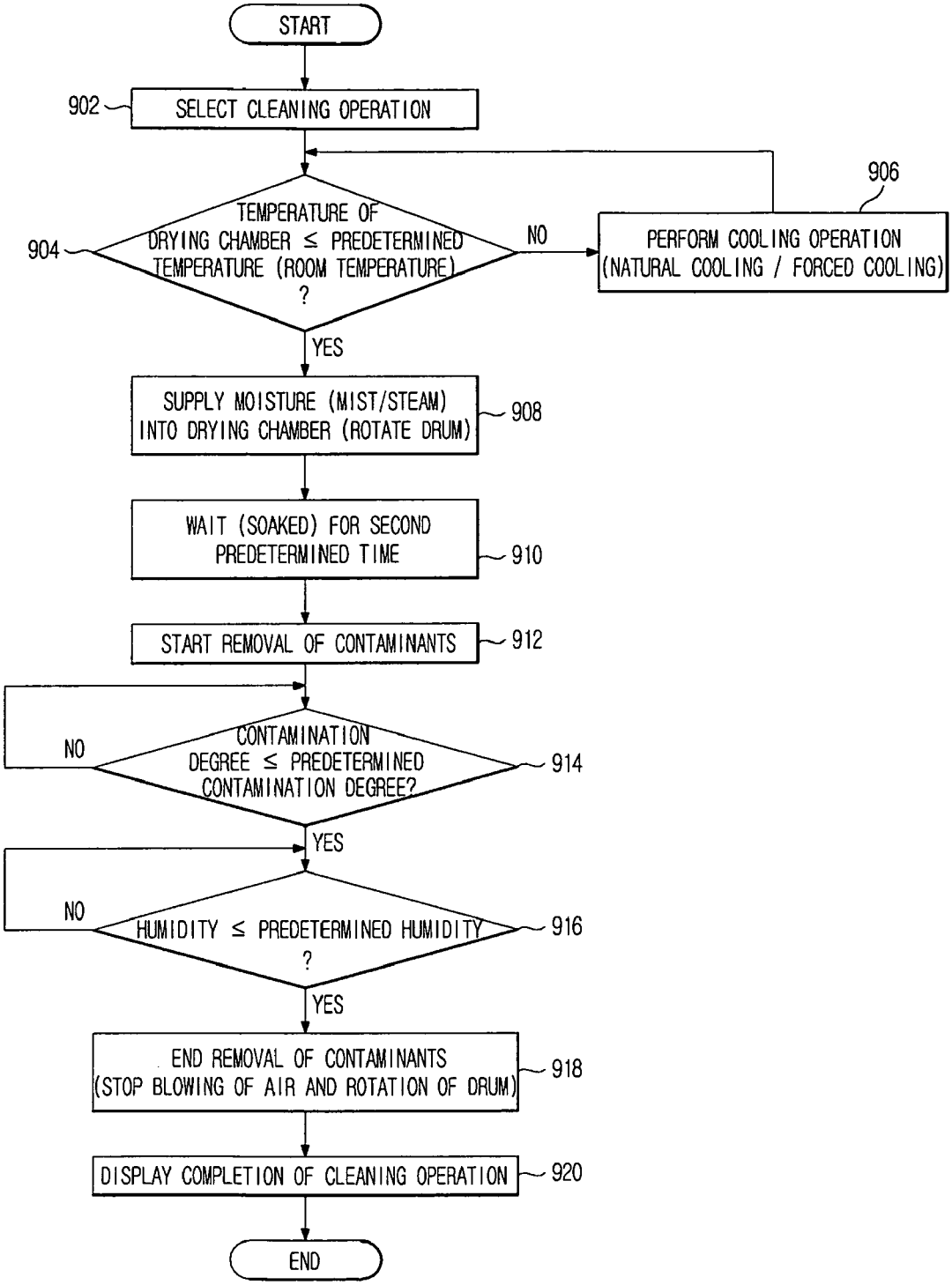
FIG. 9 is a flow chart illustrating a method of controlling a cleaning operation of a dryer according to an eighth exemplary embodiment of the present invention.

FIG. 9 is a flow chart illustrating a method of controlling a cleaning operation of a dryer according to an eighth exemplary embodiment of the present invention. The cleaning operation controlling method of FIG. 9 includes performing a cooling operation based on the temperature of the drying chamber and deciding the point of time to end a cleaning operation based on the contamination degree and humidity of the drying chamber.

As shown in FIG. 9, the method of controlling the cleaning operation of the dryer according to the eighth exemplary embodiment of the present invention begins with the selection of a cleaning operation to perform the cleaning operation (902). The selection of the cleaning operation may be carried out based on the manipulation of the cleaning operation button 304 shown in FIG. 3 or the sum of the drying operation times through the timer 806 shown in FIG. 8.

When the cleaning operation of the dryer is commenced, the temperature of the drying chamber is detected, and it is determined whether the detected temperature of the drying chamber is lower than or equal to a predetermined temperature (i.e., room temperature of approximately 25° C.) (904). This is to decide whether a cooling operation is needed or not. The predetermined temperature is a high temperature at which moisture supplied into the drying chamber is not sufficiently and uniformly applied to the surface of the drying chamber.

When the temperature of the drying chamber is higher than the predetermined temperature, and therefore, the cooling operation is needed (No at 904), the cooling operation is performed to lower the temperature of the drying chamber (906). The drying chamber may be cooled by natural cooling or forced cooling. The natural cooling is to naturally lower the temperature of the drying chamber, whereas the forced cooling is to drive the drying fan 41 or 78, such that air in the drying chamber is circulated or exhausted, to rapidly cool the drying chamber. The forced cooling in the circulation type dryer shown in FIG. 1 is to drive the drying fan 41, such that air in the drying chamber is circulated, and cool the circulated air using the condensing unit 53, 25, and 54. The forced cooling in the open type dryer shown in FIG. 2 is to drive the drying fan 78, such that air in the drying chamber is circulated, and exhaust the circulated air out of the dryer.

On the other hand, when the temperature of the drying chamber is not higher than the predetermined temperature, and therefore, the cooling operation is not needed (Yes at 904), moisture is supplied into the drying chamber such that water is coupled to contaminants on the surface of the drying chamber (908). The contaminants in the drying chamber are exposed to high temperature during the long-time drying operation, with the result that the contaminants stick to the surface of the drying chamber. Consequently, when the moisture is supplied into the drying chamber, the coupling force between the surface of the drying chamber and the contaminants is lowered by the action of the moisture, and therefore, it is possible to easily remove the contaminants. During the supply of the moisture into the drying chamber, the drum 12 or 70, defining the drying chamber, is rotated such that the moisture is sufficiently and uniformly applied to the surface of the drum 12 or 70.

When the supply of the moisture is completed, a soaking process is carried out in which the dryer does not operate for a predetermined time (a second predetermined time) such that a larger amount of moisture is coupled to the contaminants (910). The moisture is not coupled to the contaminants simultaneously when the moisture is supplied into the drying chamber. Consequently, it is preferred that the dryer does not operate for a predetermined period of time after the supply of the moisture to secure time necessary for the moisture to be sufficiently coupled to the contaminants.

After the soaking process (the waiting state) is completed, the removal of the contaminants from the surface of the drying chamber is commenced (912). In the circulation type dryer shown in FIG. 1, the drying fan 41 is driven to remove the contaminants, such that air is blown into the drying chamber and the air in the drying chamber is circulated through the filter 108 for a predetermined period of time, thereby removing the contaminants. In the open type dryer shown in FIG. 2, on the other hand, the drying fan 78 is driven to remove the contaminants, such that the air in the drying chamber is exhausted outside through the filter 208 and external air is supplied into the drying chamber, thereby removing the contaminants.

The point of time to end the removal of the contaminants is decided based on the contamination degree of the drying chamber sensed by the contamination sensor 508 and/or the humidity of the drying chamber sensed by the humidity sensor, as previously described with reference to FIG. 5. That is, when the contamination degree of the drying chamber is lower than or equal to a predetermined contamination degree (Yes at 914) and the humidity of the drying chamber is lower than or equal to a predetermined humidity (Yes at 916), the removal of the contaminants is ended (918). The removal of the contaminants is ended by stopping the drying fan 41 or 78, such that the blowing of air is stopped, and stopping the drum 12 or 70, such that the rotation of the drum 12 or 70 is stopped. When the drying heater 44 or 76 is driven to blow heated air, during the removal of the contaminants, the drying heater 44 or 76 is also turned off at the time of ending the removal of the contaminants.

After the removal of the contaminants is completed, the completion of the drying chamber cleaning operation is displayed on the display 304, of the control panel 102 or 206, shown in FIG. 3, such that a user recognizes the completion of the cleaning operation (920).

In the eighth exemplary embodiment of the present invention shown in FIG. 9 as described above, the drum 12 or 70, defining the drying chamber, is rotated from when the moisture is supplied into the drying chamber to when the removal of the contaminants is completed, thereby improving efficiency in the application of moisture and the removal of contaminants. Alternatively, it is possible to temporarily interrupt the rotation of the drum 12 or 70 during the soaking process (the waiting state) to reduce power consumption and extend the service life of the drum 12 or 70 and the motor 13 or 90 and resume the rotation of the drum 12 or 70 after the soaking time (the waiting time) elapses.

Figure 10:
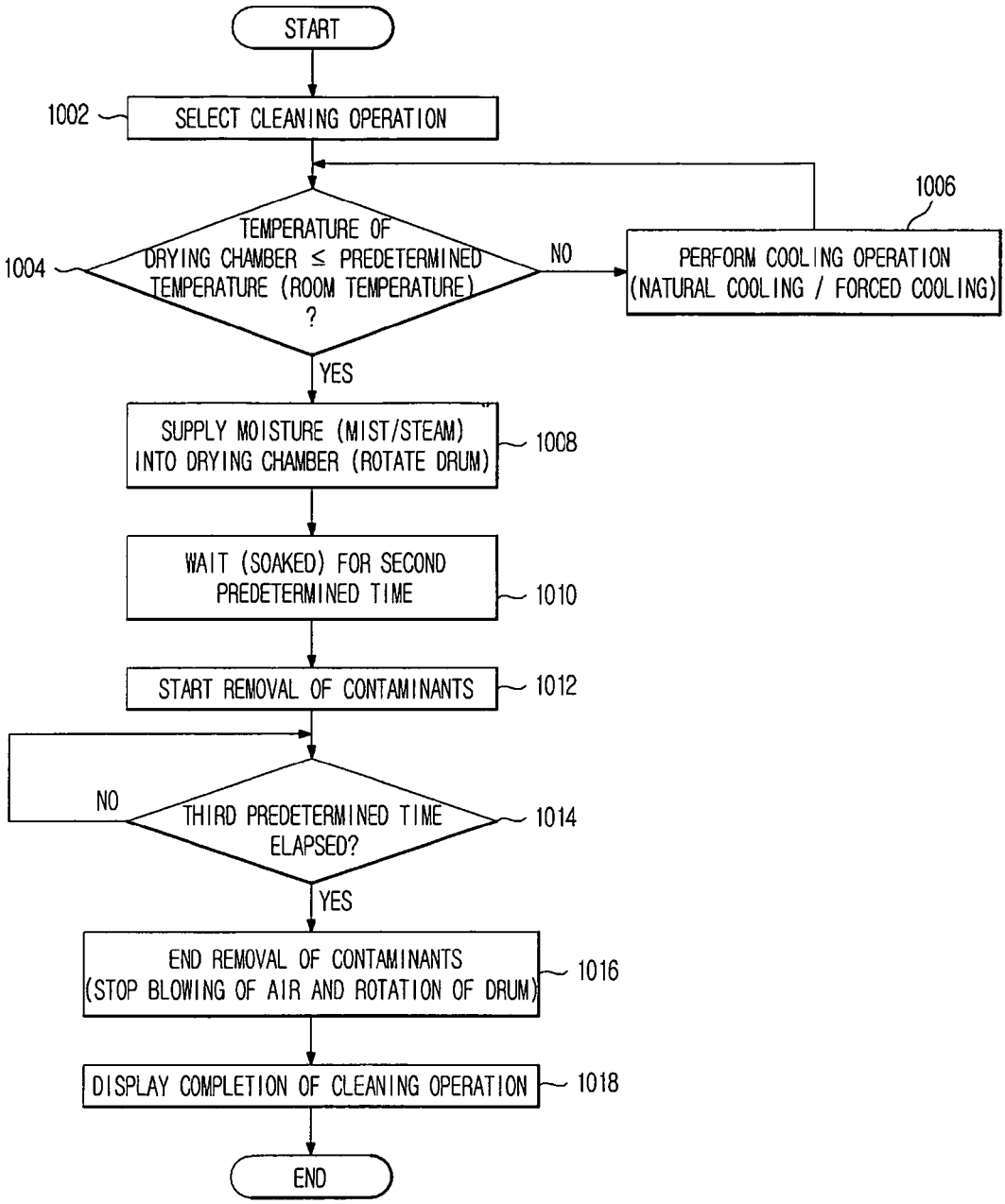
FIG. 10 is a flow chart illustrating a method of controlling a cleaning operation of a dryer according to a ninth exemplary embodiment of the present invention.

FIG. 10 is a flow chart illustrating a method of controlling a cleaning operation of a dryer according to a ninth exemplary embodiment of the present invention. The cleaning operation controlling method of FIG. 10 includes performing a cooling operation based on the temperature of the drying chamber and removing contaminants for a predetermined fixed period of time.

In the flow chart of FIG. 10, blocks indicated by reference numerals 1002, 1004, 1006, 1008, 1010, 1012, 1016, and 1018 are the same as those of FIG. 9 indicated by reference numerals 902, 904, 906, 908, 910, 912, 918, and 920. However, deciding the point of time to end the removal of contaminants is different. That is, when it is determined that a predetermined time (a third predetermined time) elapses during the removal of the contaminants for the predetermined fixed period of time (Yes at 1014), the removal of the contaminants is ended (1016).

Figure 11:
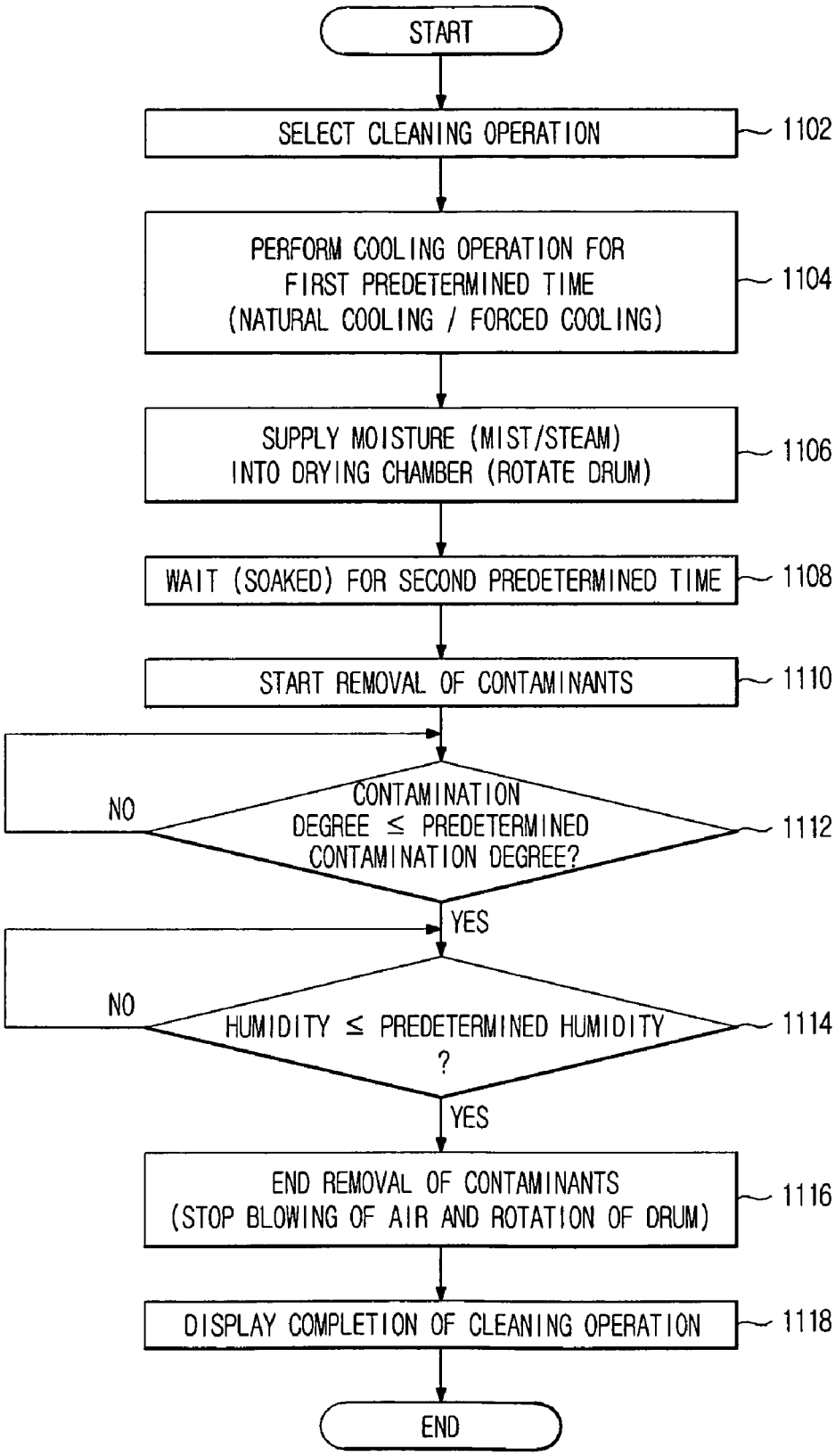
FIG. 11 is a flow chart illustrating a method of controlling a cleaning operation of a dryer according to a tenth exemplary embodiment of the present invention.

FIG. 11 is a flow chart illustrating a method of controlling a cleaning operation of a dryer according to a tenth exemplary embodiment of the present invention. The cleaning operation controlling method of FIG. 11 includes immediately performing a cooling operation for a predetermined fixed period of time, without detecting the temperature of the drying chamber, and deciding the point of time to end a cleaning operation based on the contamination degree and humidity of the drying chamber.

As shown in FIG. 11, the method of controlling the cleaning operation of the dryer according to the tenth exemplary embodiment of the present invention begins with the selection of a cleaning operation to perform the cleaning operation (1102). The selection of the cleaning operation may be carried out based on the manipulation of the cleaning operation button 304 shown in FIG. 3 or the sum of the drying operation times through the timer 806 shown in FIG. 8.

When the cleaning operation of the dryer is commenced, the temperature of the drying chamber is not detected, but a cooling operation is immediately performed to lower the temperature of the drying chamber for a predetermined time (a first predetermined time) (1104). The drying chamber may be cooled by natural cooling or forced cooling. The natural cooling is to naturally lower the temperature of the drying chamber, whereas the forced cooling is to drive the drying fan 41 or 78, such that air in the drying chamber is circulated or exhausted, to rapidly cool the drying chamber. The forced cooling in the circulation type dryer shown in FIG. 1 is to drive the drying fan 41, such that air in the drying chamber is circulated, and cool the circulated air using the condensing unit 53, 25, and 54. The forced cooling in the open type dryer shown in FIG. 2 is to drive the drying fan 78, such that air in the drying chamber is circulated, and exhaust the circulated air out of the dryer. Blocks of FIG. 11 indicated by reference numerals 1106, 1108, 1110, 1112, 1114, 1116, and 1018 are the same as those of FIG. 9 indicated by reference numerals 908, 910, 912, 914, 916, 918, and 920.

The tenth exemplary embodiment of the present invention shown in FIG. 11 may be applied to a dryer having no temperature sensor or a dryer having a temperature sensor, which however cannot detect temperature due to a breakdown or the like.

Figure 12:
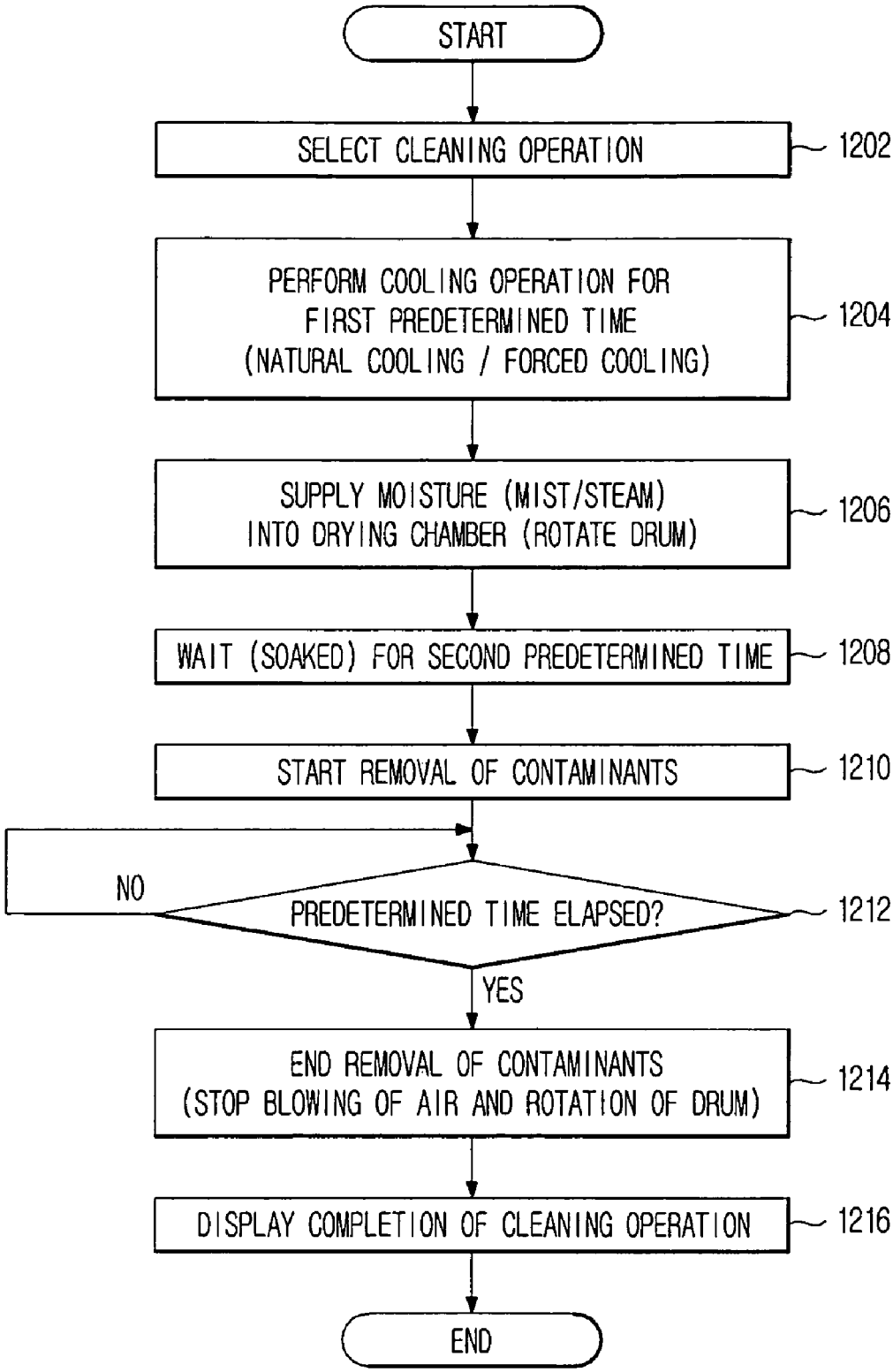
FIG. 12 is a flow chart illustrating a method of controlling a cleaning operation of a dryer according to an eleventh exemplary embodiment of the present invention.

FIG. 12 is a flow chart illustrating a method of controlling a cleaning operation of a dryer according to an eleventh exemplary embodiment of the present invention. The cleaning operation controlling method of FIG. 12 includes immediately performing a cooling operation for a predetermined fixed period of time, without detecting the temperature of the drying chamber, and removing contaminants for a predetermined fixed period of time.

In the flow chart of FIG. 12, blocks indicated by reference numerals 1202, 1204, 1206, 1208, 1210, 1214, and 1216 are the same as those of FIG. 11 indicated by reference numerals 1102, 1104, 1106, 1108, 1110, 1116, and 1118. However, deciding the point of time to end the removal of contaminants is different. That is, when it is determined that a predetermined time elapses during the removal of the contaminants for the predetermined fixed period of time (Yes at 1212), the removal of the contaminants is ended (1214).

The execution of the cooling operation and removal of the contaminants for the predetermined fixed periods of time without detection of the contamination degree and the humidity as well as detection of the temperature may be applied to a dryer having no sensors (or a dryer having sensors, which however cannot normally work due to a breakdown or the like) as in the fifth exemplary embodiment shown in FIG. 6.

As apparent from the above description, moisture is supplied into the drying chamber of the dryer to wet contaminants in the drying chamber, and then air is blown to the wetted contaminants to remove the contaminants. Consequently, the dryer is maintained in a clean state, whereby clothes, i.e., objects to be dried, are not contaminated. In particular, the drying chamber is cooled, such that the moisture is supplied into the drying chamber in a state in which the temperature of the drying chamber is relatively low, whereby the moisture is sufficiently and uniformly applied to the surface of the drying chamber.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A method of controlling a cleaning operation of a dryer, comprising the sequential steps of:

measuring a temperature of a drying chamber;

cooling the drying chamber when the measured temperature of the drying chamber is higher than a predetermined temperature;

supplying moisture into a drying chamber to wet contaminants in the drying chamber;

waiting for a first predetermined time, such that the supplied moisture is coupled to the contaminants in the drying chamber after the supply of the moisture is completed; and removing the contaminants by blowing air into the drying chamber to remove the contaminants wetted by the moisture.

2. The method according to claim 1, wherein the drying chamber is a rotary drum, and the method further comprises rotating the rotary drum while supplying the moisture.

3. The method according to claim 1, wherein the cooling of the drying chamber comprises exhausting air in the drying chamber outside and supplying external air into the drying chamber to forcibly cool the drying chamber.

4. The method according to claim 1, wherein the cooling of the drying chamber comprises circulating cool air in the drying chamber to forcibly cool the drying chamber.

5. The method according to claim 1, wherein the cooling of the drying chamber further comprises:

performing a cooling operation to lower a temperature of the drying chamber for a second predetermined time before supplying the moisture.

6. The method according to claim 1, wherein the step of removing the contaminants includes circulating the air in the drying chamber through a filter for a third predetermined time or exhausting the air in the drying chamber outside through the filter and supplying external air into the drying chamber to remove the contaminants.

7. The method according to claim 1, wherein the step of removing the contaminants includes detecting a degree of contamination of the air discharged from the drying chamber, the removing of the contaminants being performed until the degree of contamination of the air discharged from the drying chamber is lower than or equal to a predetermined contamination degree.

8. The method according to claim 1, wherein the cleaning operation is performed based on a user's input.

9. The method according to claim 5, wherein the cooling operation of the drying chamber exhausts air in the drying chamber outside and supplies external air into the drying chamber to forcibly cool the drying chamber.

10. The method according to claim 5, wherein the cooling operation of the drying chamber circulates and cools air in the drying chamber to forcibly cool the drying chamber.

11. A method of controlling a cleaning operation of a dryer, comprising the sequential steps of:

measuring a temperature of a drying chamber;

performing a cooling operation of the drying chamber to lower the temperature of the drying chamber to a predetermined temperature when the measured temperature is higher than the predetermined temperature;

supplying moisture into the drying chamber to wet contaminants in the drying chamber;

forming a contaminant film by soaking the contaminants wetted by the moisture; and removing the contaminant film.

12. The method according to claim 11, wherein the cooling operation of the drying chamber forcibly cools the drying chamber to the predetermined temperature or less than the predetermined temperature.

13. The method according to claim 11, wherein the step of removing the contaminant film includes circulating air in the drying chamber through a filter for a predetermined time or exhausting the air in the drying chamber outside through the filter and supplying external air into the drying chamber.

14. A method of controlling a cleaning operation of a dryer, comprising the sequential steps of:

measuring a temperature of a drying chamber;

performing a cooling operation of the drying chamber to lower the temperature of the drying chamber for a first predetermined time when the measured temperature of the drying chamber is higher than a predetermined temperature;

supplying moisture into the drying chamber to wet contaminants in the drying chamber;

forming a contaminant film by soaking the contaminants wetted by the moisture;

waiting for a second predetermined time, such that the supplied moisture is coupled to the contaminants in the drying chamber after the supply of the moisture is completed; and removing the contaminant film by blowing air into the drying chamber to remove the contaminants wetted by the moisture.

15. The method according to claim 14, wherein the cooling operation of the drying chamber forcibly cools the drying chamber to a predetermined temperature or less than a predetermined temperature.

16. The method according to claim 14, wherein the step of removing the contaminant film includes circulating air in the drying chamber through a filter for a third predetermined time or exhausting the air in the drying chamber outside through the filter and supplying external air into the drying chamber.

* * * * *